United States Patent [19]

VanTassel

[11] Patent Number: 5,072,569

[45] Date of Patent: Dec. 17, 1991

[54] BUILDING PANELS AND METHOD THEREOF

[76] Inventor: James VanTassel, 608 Elk St., Franklin, Pa. 16323

[21] Appl. No.: 566,058

[22] Filed: Aug. 13, 1990

[51] Int. Cl.[5] ..... E04B 1/00

[52] U.S. Cl. ..... 52/745; 52/309.4; 52/309.7; 52/309.16

[58] Field of Search ..... 52/309.4, 309.7, 241, 52/309.16, 780, 744, 489, 562, 563, 564, 565, 745, 777, 475, 476

[56] References Cited

U.S. PATENT DOCUMENTS

| | | | |
|---|---|---|---|
| 2,883,852 | 4/1959 | Midby | 52/241 |
| 3,484,331 | 12/1969 | Betz | 52/309.7 |
| 3,753,328 | 8/1973 | Papso | 52/745 |
| 3,826,051 | 7/1974 | Miller et al. | 52/241 |
| 4,299,069 | 11/1981 | Neumann | 52/309.4 |

*Primary Examiner*—Richard E. Chilcot, Jr.
*Assistant Examiner*—Robert Caufield
*Attorney, Agent, or Firm*—Charles L. Lovercheck; Wayne L. Lovercheck

[57] ABSTRACT

A building panel that is generally rectangular is cross section and relatively thick. Recesses are cut in the Styrofoam panel that are shaped to snugly receive studs. The studs are exposed at their ends whereby they can be attached to upper and lower channel shaped structural members. The upper and lower structural members receive ends of top and bottom structural members and are attached thereto which are attached to a building structure. Electric wire chase channels are formed in the Styrofoam panel.

8 Claims, 4 Drawing Sheets

BUILDING PANELS AND METHOD THEREOF

BACKGROUND OF THE INVENTION

This invention relates to building panels and more particularly to insulated building panels. Insulated panels are familiar to those skilled in the art, particularly panels made for modular buildings. No completely satisfactory method or structure has been found to provide a supporting frame for Styrofoam panels. Applicant is aware of the Styrofoam building panels shown in the book entitled Foam-Core Panels and Building Systems Principles and Practice Plus Product Directory, by Steve Andrews, Cutter Information Corp., 1100 Massachusetts Avenue, Arlington, Me. 02174. U.S.A.

SUMMARY OF THE INVENTION

Applicant has found that recesses can be cut in thermoplastic panels such as Styrofoam panels that are facsimiles of the shape of structural members, such is relatively thin metal or plastic such as aluminum, steel or Fiberglas. The structural members can be in the shape of channels, for example. The recesses can be readily cut by the hot wire method familiar to those working in the art.

The structural members can be inserted in one end of the recess and extend through the recess to the other end so that they extend from end to end of the panel, so that lower ends of the structural members can be received in and attached to upwardly facing lower channels and the upper ends of the structural members can be received in upper channels. The lower channels can have outwardly inclined ends and can be inserted in upwardly facing base channels attached to a floor or the like. The lower channels can be lowered into the base channels, thus locking the lower channels in position.

Important features of the Panel disclosed herein are:

1. Vertical wire chases are centered between the structural members. The reason for this is to be able to locate these chases with a metal indicator.

2. The process of cutting into urethane or polystyrene foam by means of a hot wire in order to locate metal studding in the center of the foam panels.

3. The use of any insulating foam material to laterally brace metal studding, floor joists, and rafters.

4. The use of interlocking metal "U" shaped tracks. The first bottom track is attached to the metal studs primarily to keep the studding in place. The second bottom track is used to attach the panels to the floors and also as base trim. The upper track holds each panel to the panel adjacent it, and has a secondary function of being able to fasten floor joists or roof trusses to the wall panels.

5. The use of vertical or horizontal grooves in the foam panels to attach siding products and other finishes.

It is an object of the invention to provide an improved building panel.

Another object of the invention is to provide a building panel that is simple in construction, economical to manufacture and simple and efficient to build.

Another object of the invention is to provide an improved building panel made of Styrofoam with steel structural members embedded therein.

Another object is to provide an improved method of building.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DESCRIPTION OF THE PREFERRED EMBODIMENT

Figure 1:
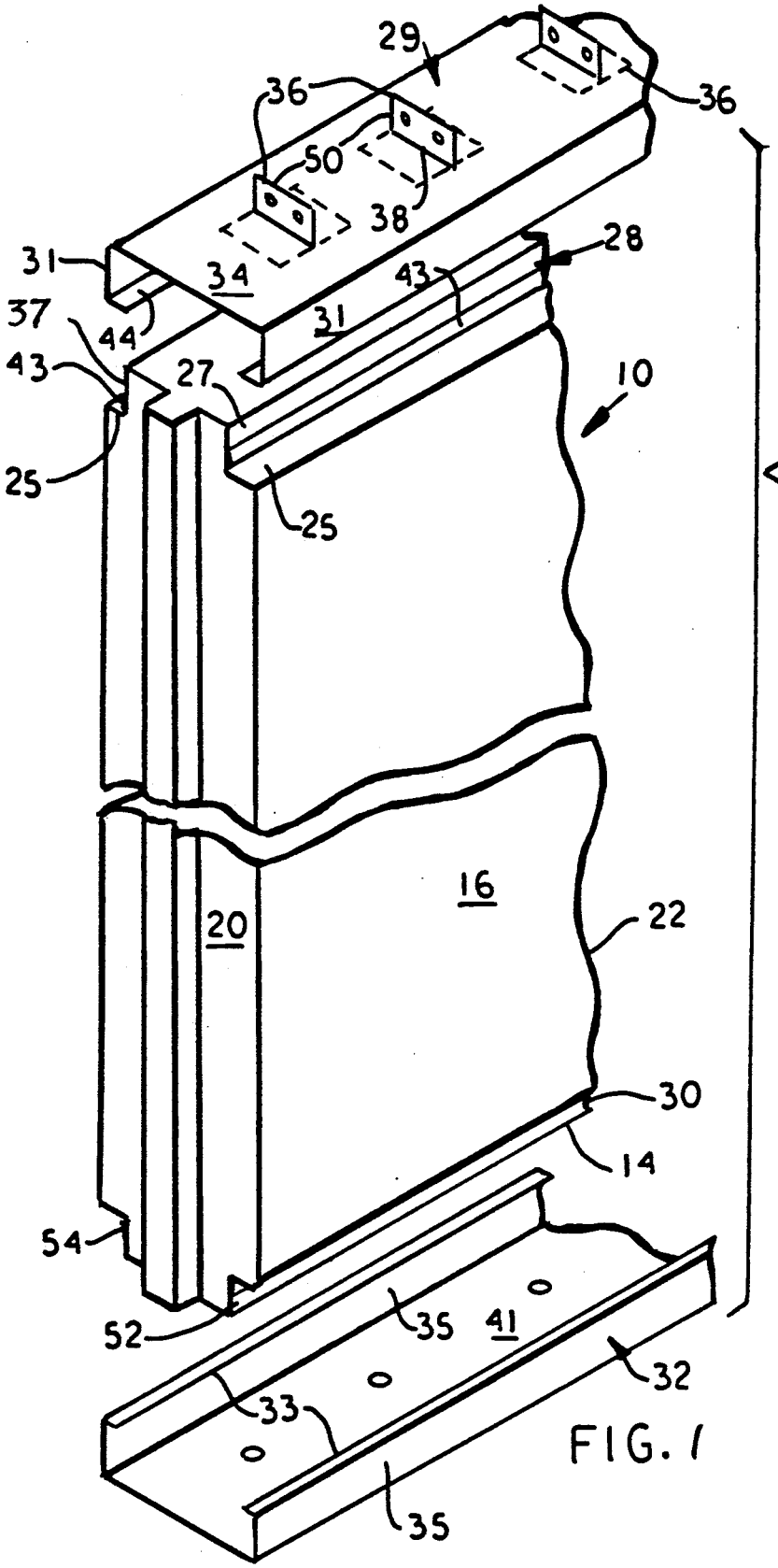
FIG. 1 is an exploded isometric view of the building panel and channel according to the invention.
Figure 2:
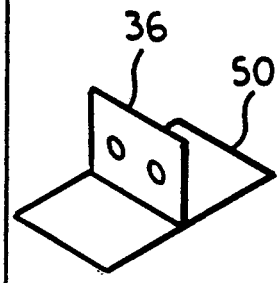
FIG. 2 is an isometric view of the clip shown in FIG. 1.
Figure 3:
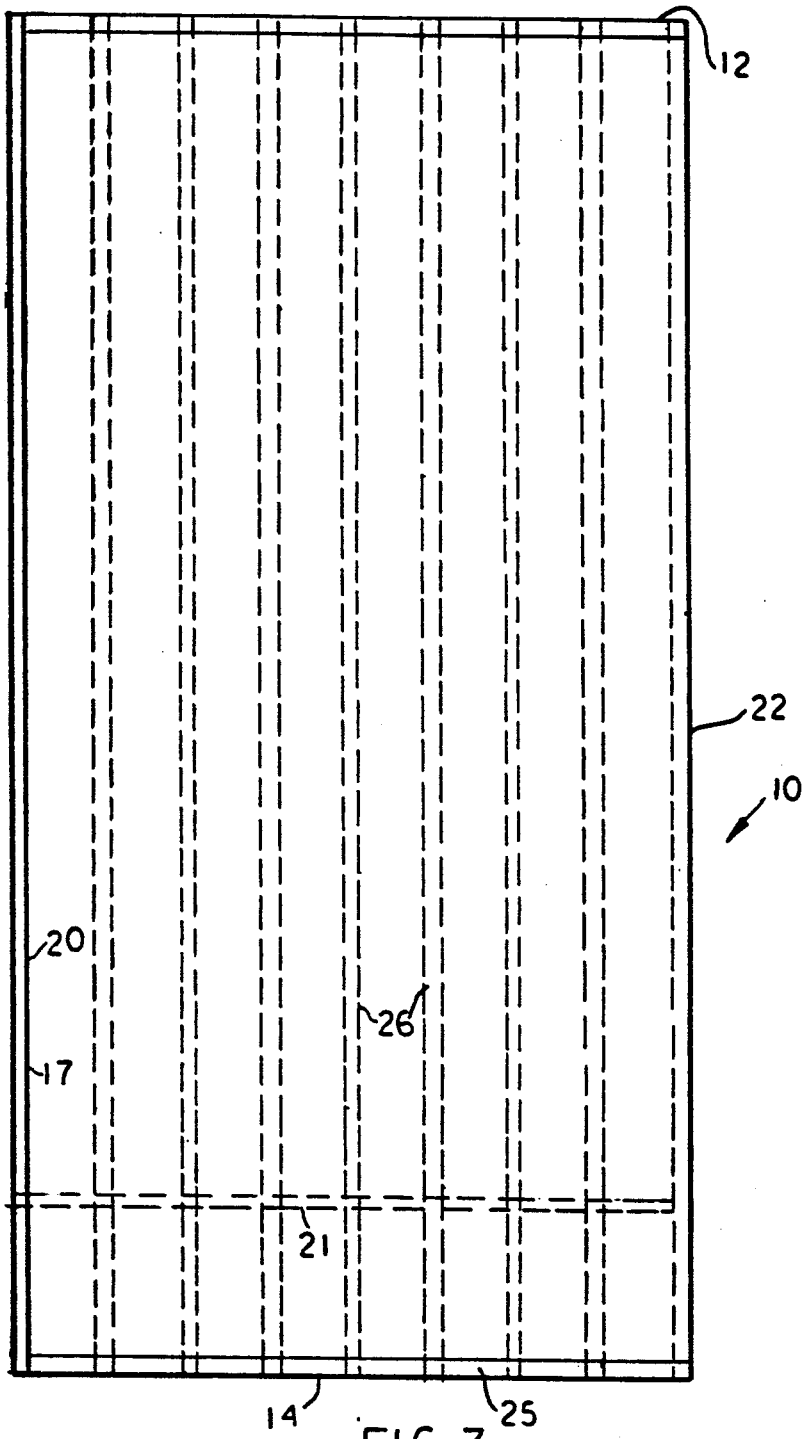
FIG. 3 is a front view of the panel shown in FIG. 1.
Figure 4:
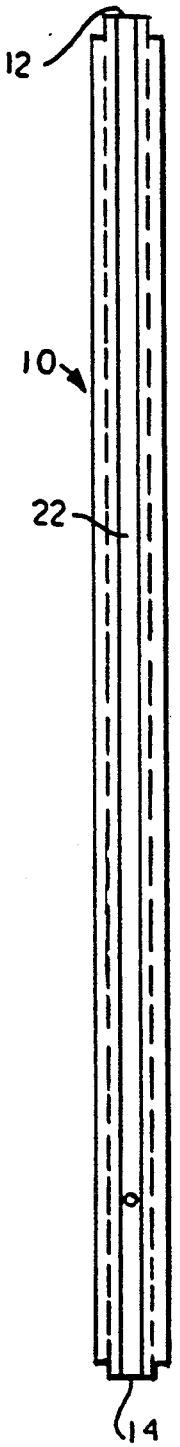
FIG. 4 is a side view of the panel shown in FIG. 1.
Figure 5:
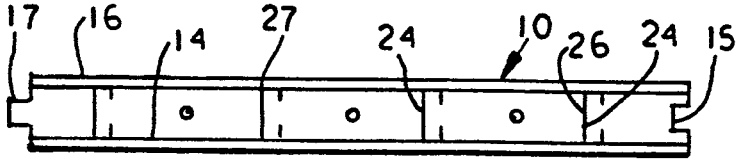
FIG. 5 is an end view of the panel according to the invention.
Figure 6:
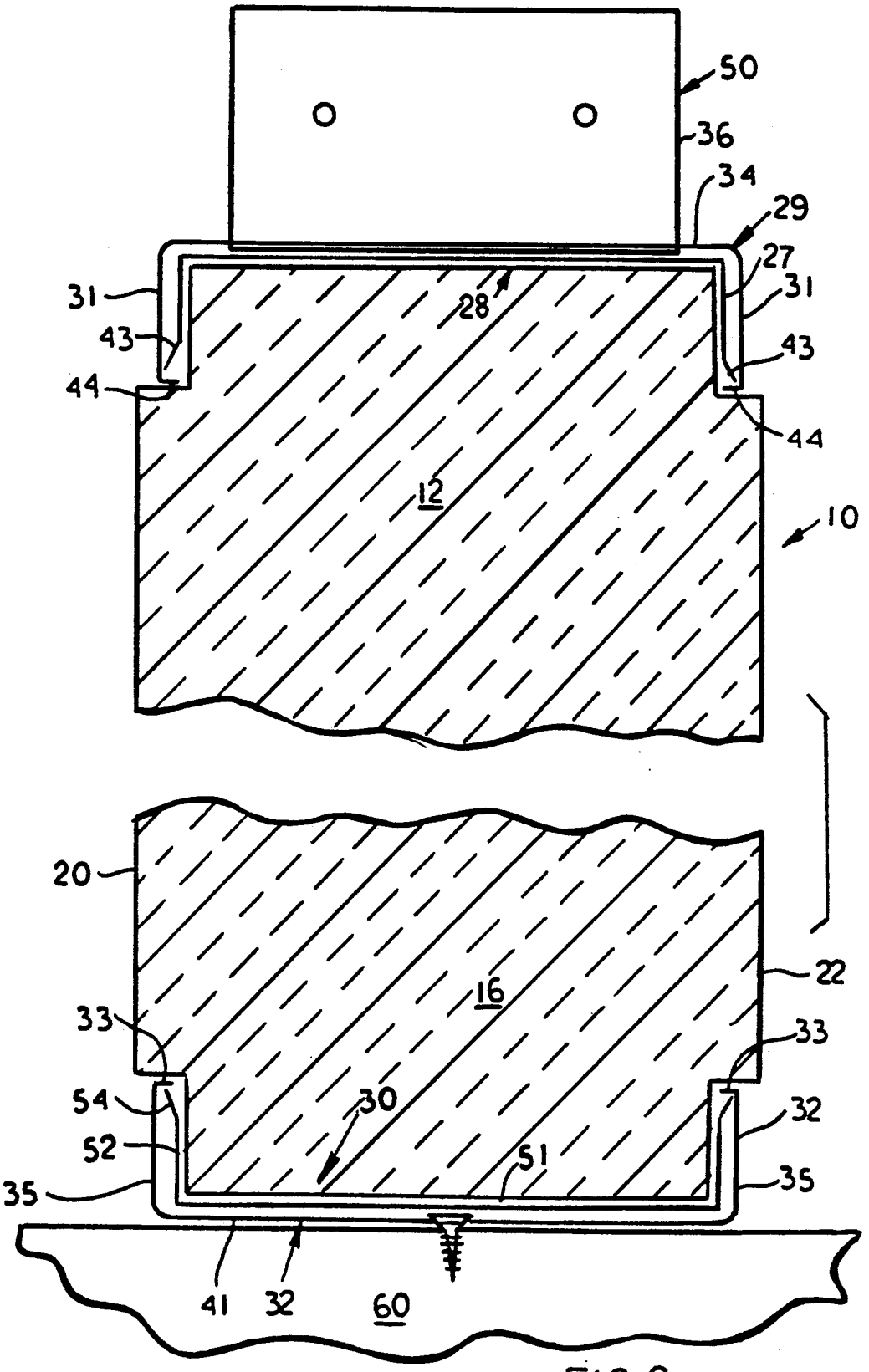
FIG. 6 is a front view of the panel with upper and lower channels in plane according to the invention.
Figure 8:
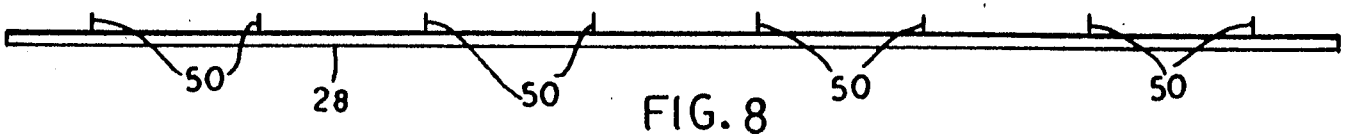
FIG. 8 is a side view of the upper channel.

Now with more particular reference to the drawings, panel 10 having a styrofoam block 28 is shown having upper end 12, lower end 14, first side 16, second side 18, first edge 20 and second edge 22 to be attached to building structure 60.

Figure 9:
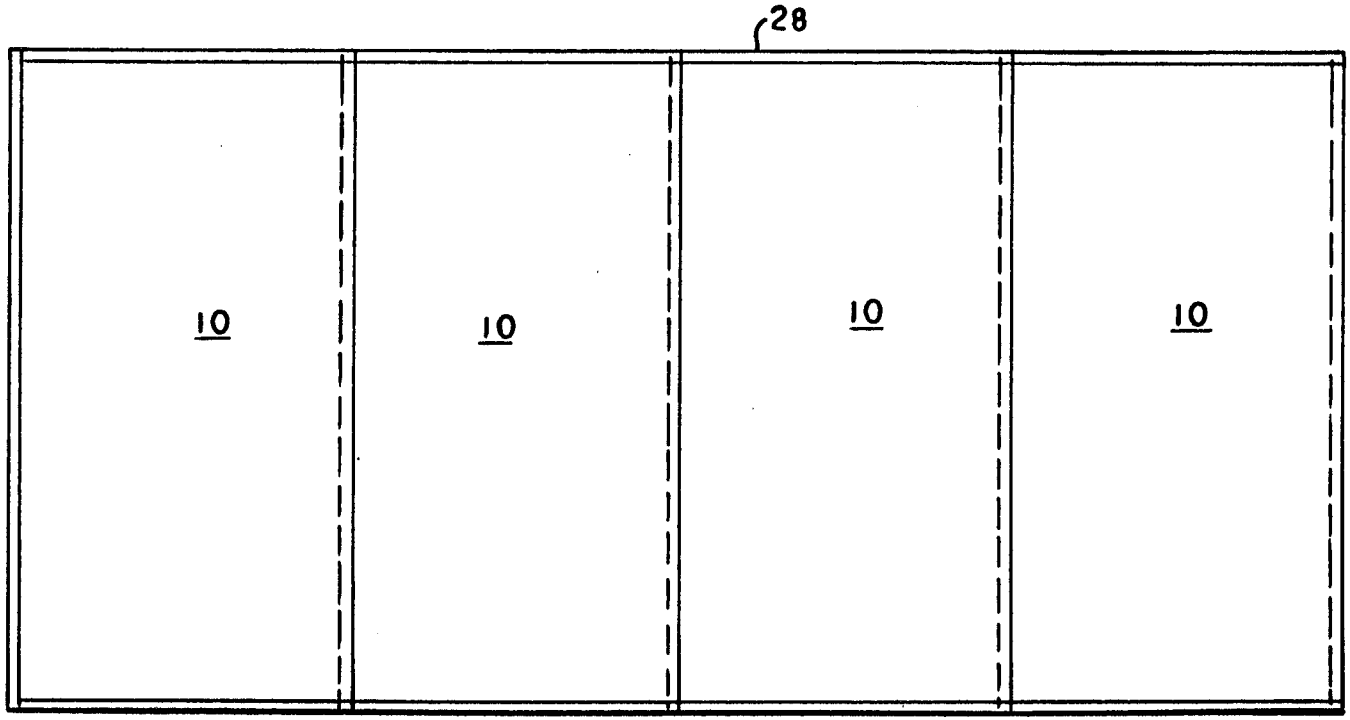
FIG. 9 is a side view of a wall made up of several panels held in place with an upper and a lower channel.
Figure 7:
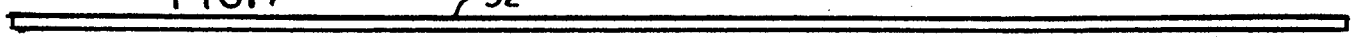
FIG. 7 is a side view of a base channel.

Second edge 22 of panel 10 has groove 15 cut therein. Groove 15 is adapted to receive tongue 17 of an adjacent panel when panel 10 is erected in side by side relation with similar panels in a wall as shown in FIG. 9. Lateral grooves 25 are formed along the edge of upper end 12 and lower end 14 to receive top channel flanges 27 and lower channel flanges 52.

Longitudinally extending recesses 24 are cut in panel 10 and terminate in spaced relation to first side 16 and second side 18. Recesses 24 can be cut by a familiar method by electrically heating a stainless steel wire to a suitable temperature, for example, a dull red heat, and moving the wire in the pattern desired of recesses 24 to be formed. Thus, longitudinally extending recesses 24 closely approximating the size and shape of channel shaped studs 26. Therefore, studs 26 are firmly held in position in recesses 24. Studs 26 can be inserted into recesses 24 from upper end 12 to lower end 14 or vise versa.

Electric wire receiving chase 21 can be formed by inserting a hot wire in Styrofoam panel 10 from first edge 20 to second edge 22. Channel shaped studs 26, upper channel 29, to channel 37, lower channel 30 and base channel 32 may be made of a relatively thin steel material, for example, 18, 20 or 22 gage steel.

Upper end 12 is received in top channel 37. Top channel 37 is attached to upper channel 29 which may have spaced lateral slots 38 in first web 34 through which bars 36 of clips 50 can extend. Top channel 37 has outwardly extending distal ends 43 which underlie inwardly directing ends 44 of upper channel flanges 31. Upper channel 29 has second web 34.

Lower end 14 is attached to lower channel 30. Lower channel 30 has third web 51 and lower channel flanges 52 with outwardly inclined distal ends 54. Base channel 32 has web 41 with base channel flanges 35 fixed to fourth web 41. Lower channel flanges 52 snap under outer ends 33 of base channel flanges 32 and hold panel 10 in position. Distal ends 44 of top channel flanges 31 extend inwardly from second web 34 forming hooks which overlie distal ends 43 of upper channel flanges 27 to hold upper channel 29 in place.

The foregoing specification sets forth the invention in its preferred, practical forms but the structure shown is capable of modification within a range of equivalents without departing from the invention which is to be understood is broadly novel as is commensurate with the appended claims.

I claim:

1. A method of making a building panel with a support frame for wall, roof and floor construction comprising:

providing a panel of foam thermoplastic having a first side, a second side, an upper end, a lower end, a first edge, a second edge, and a width, providing relatively thin metallic studs, and a top channel and a lower channel, each channel having flanges, said top channel and said lower channel each having a length substantially equal to the width of said panel, said method further comprising forming laterally spaced longitudinally extending recesses in said panel, said recesses extending from said upper end of said panel to said lower end of said panel, said recesses being shaped to receive said studs and to provide lateral support for said studs, inserting said studs into said recesses from said upper end of said panel to said lower end of said panel, attaching said studs to said top channel and to said lower channel, inserting said lower end of said panel into said lower channel, inserting said upper end of said panel into said top channel and, attaching said top channel and said lower channel to a building structure.

2. The method recited in claim 1 further providing an upper channel, said upper channel having a web, inserting said top channel in said upper channel and fixing said web to said building structure whereby said top channel is fixed to said building structure.

3. The method recited in claim 2 further providing a base channel, said base channel having a web and spaced flanges with inwardly extending ends, fixing said base channel to said building structure and inserting said lower channel into said base channel with said inwardly extending ends of said spaced flanges of said base channel overlying said flanges of said lower channel whereby said lower channel is retained in said base channel and said lower end of said panel is held in position.

4. The method recited in claim 3 further includes forming a longitudinally extending tongue on said first edge of said block from said upper end to said lower end, forming a longitudinal groove in said second edge of said block from said upper end to said lower end and inserting said longitudinally extending tongue of an adjacent similar said panel into said groove.

5. The method recited in claim 2 further includes forming spaced second recesses in said upper end of said block extending from said first edge to said second edge and inserting an upper channel in said second recesses, forming spaced third recesses in said lower end of said block and inserting said flanges of said lower channel into said third recesses.

6. The method recited in claim 5 wherein said method further includes attaching said flanges of said lower channel to said studs.

7. The method recited in claim 1 wherein said first side and said second side of said panel are provided with a tongue and groove respectively for connecting said panel in series with other panels.

8. A panel comprising, a generally rectangular block of thermoplastic material having an upper end, a lower end, a first side, a second side, a first edge, a second edge and spaced longitudinally extending recesses formed in said block, said recesses being spaced inwardly from said first edge, from said second edge, from said first side and from said second side of said block, said recesses closely approximately the size and shape of longitudinally extending studs, whereby said thermoplastic material provides lateral support for said studs, said longitudinally extending studs being received in said recesses and fitting snugly therein, a top channel shaped member receiving said upper end of said block, said top channel shaped member further receiving and being attached to said upper ends of said studs, a lower channel member receiving said lower end of said block, said lower channel member further receiving and being attached to said lower ends of said studs, first attaching means on said top channel shaped member for attaching said block to a building structure, second attaching means for attaching said lower channel to said building structure.

* * * * *